US005209561A

United States Patent [19]

Bond

[11] Patent Number: 5,209,561

[45] Date of Patent: May 11, 1993

[54] FLAT-PACK CONICAL LANTERN REFLECTOR

[76] Inventor: Joseph N. Bond, 28 Sarina Dr., Commack, N.Y. 11725

[21] Appl. No.: 818,234

[22] Filed: Jan. 8, 1992

[51] Int. Cl.[5] ..... F21L 19/00

[52] U.S. Cl. ..... 362/163; 362/313; 362/352; 220/4.24

[58] Field of Search ..... 362/157, 159, 160, 161, 362/162, 167, 168, 174, 297, 306, 313, 319, 320, 346, 347, 352, 361, 313, 182, 163; D26/135; 220/4.24

[56] References Cited

U.S. PATENT DOCUMENTS

| | | | |
|---|---|---|---|
| 91,130 | 6/1869 | Hendryx | 362/361 |
| 103,928 | 6/1870 | Read, Jr. | 362/360 |
| 199,269 | 1/1878 | Cutter | 362/361 |
| 714,514 | 11/1902 | Osbron | 362/313 |
| 760,992 | 5/1904 | Huse | 362/313 |
| 780,875 | 1/1905 | Duncan | 362/361 |
| 932,772 | 8/1909 | Fleck | 362/162 |
| 1,547,026 | 7/1925 | Canney | 362/320 |
| 1,654,482 | 12/1927 | Herman | D26/135 |
| 2,098,843 | 11/1937 | Watrous | 362/359 |
| 2,785,290 | 3/1957 | Terry | 362/159 |
| 4,132,457 | 1/1979 | Parrish et al. | 220/4.24 |

*Primary Examiner*—Ira S. Lazarus
*Assistant Examiner*—L. Heyman
*Attorney, Agent, or Firm*—Whitham & Marhoefer

[57] ABSTRACT

A frusto-conical lantern reflector comprised of two semicircular, flat sheets made of a resilient material, each with at least one surface that reflects light. Each generally semicircular sheet has a semicircular cut-out that forms an opening in the top of the assembled reflector. Fasteners are located on either side of the cut-away semicircular portion; the fasteners on one sheet are disposed to releasably mate with the fasteners on the other sheet so that when the sheets are deflected and the fasteners on the one sheet are aligned with the fasteners on the second sheet, the two sheets together form a frusto-conical reflector.

3 Claims, 3 Drawing Sheets

FLAT-PACK CONICAL LANTERN REFLECTOR

BACKGROUND OF THE INVENTION

1. Field of the Invention

The present invention generally relates to a conical reflector for use with portable lanterns, and more specifically, a conical reflector that can be easily disassembled into two flat sheets for easy storage and transport when not in use, and easily reassembled for use.

2. Description of the Prior Art

Lanterns used by campers, such as candle lanterns, generally, do not provide sufficient light in the area directly below their base. The base is directly below the source of illumination and casts a shadow. A conical reflector can eliminate or reduce the shadow and the use of conical reflectors to direct lantern light downward is known in the art; examples include: U.S. Pat. No. 760,922 to Huse and U.S. Pat. No. 2,785,290 to Terry.

Huse shows a canopy for chimney tops which may be collapsed or folded for shipping purposes. The chimney is assembled by overlapping two or more rigid mica conical pieces and joining them together at the edges by rivets. The rigid conical mica pieces when disassembled do not lie flat.

Terry shows a lantern reflector formed from a single piece of sheet material which is joined together at a seam.

Campers carry articles such as lanterns and space is limited. Prior art lantern reflectors are generally bulky, and therefore undesirable.

SUMMARY OF THE INVENTION

An object of the present invention is to provide a light-weight conical reflector for a lantern (particularly a candle lantern) can be repeatedly and easily assembled and disassembled; one that packs flat.

A further object of the present invention is to provide a reflector that is inexpensive to manufacture.

The present invention contemplates a frusto-conical lantern reflector comprised of two semicircular, flat sheets made of a resilient material with a light reflecting surface. Each generally semicircular sheet has a semicircular cutout that forms an opening in the top of the assembled reflector. Fasteners are located on either side of the cut-away semicircular portion; the fasteners on one sheet are disposed to releasably mate with the fasteners on the other sheet. The releasable fasteners are located so the must be deflected in order to bring the fasteners on the one sheet into alignment with the mating fasteners on the second sheet so that the two sheets together form a frusto-conical reflector.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
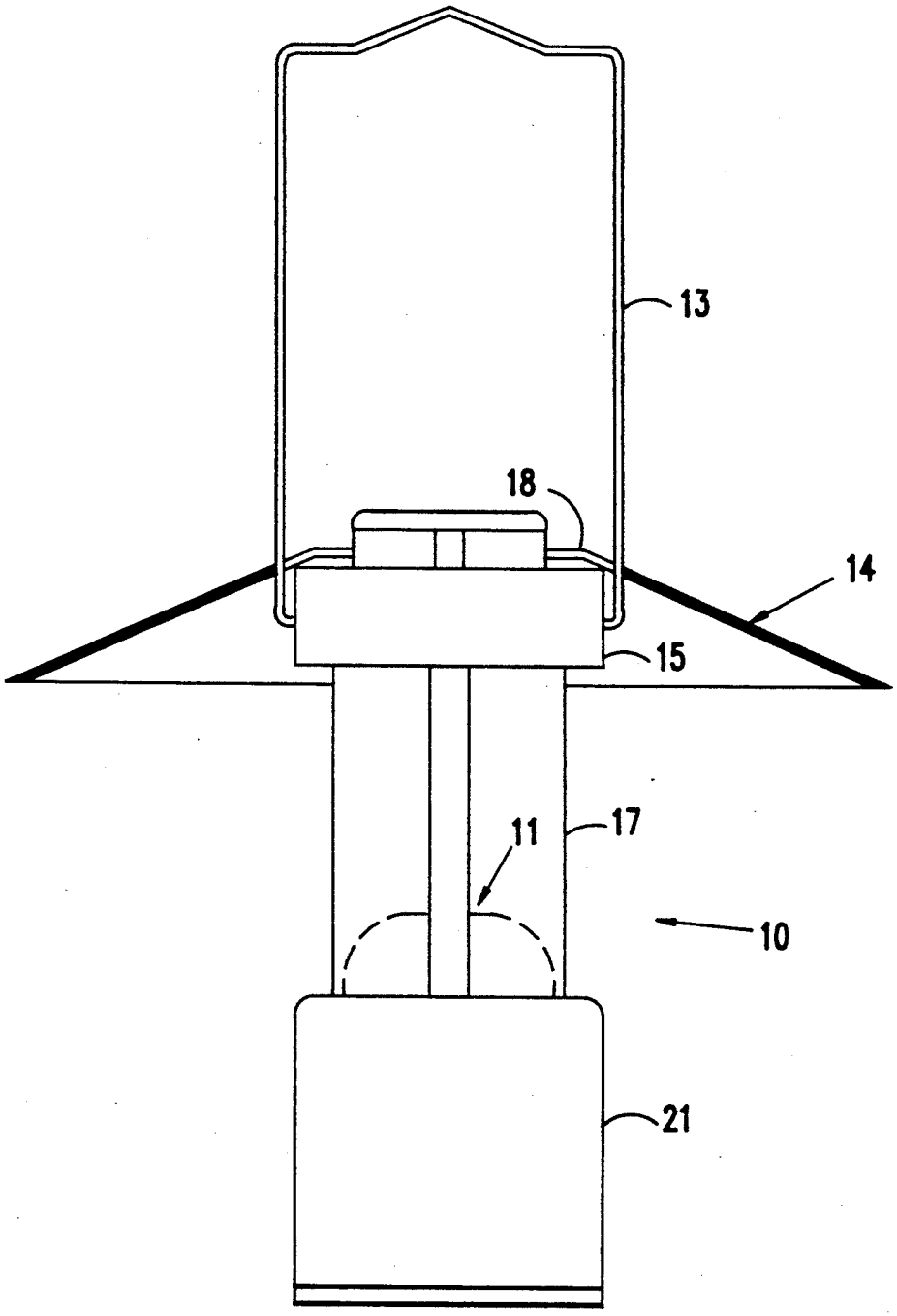
FIG. 1 shows the lantern reflector of the present invention installed atop a candle lantern. The conical reflector has been slipped down over the bail handle of the lantern until it rests on a support ring on the lantern chimney.
Figure 2:
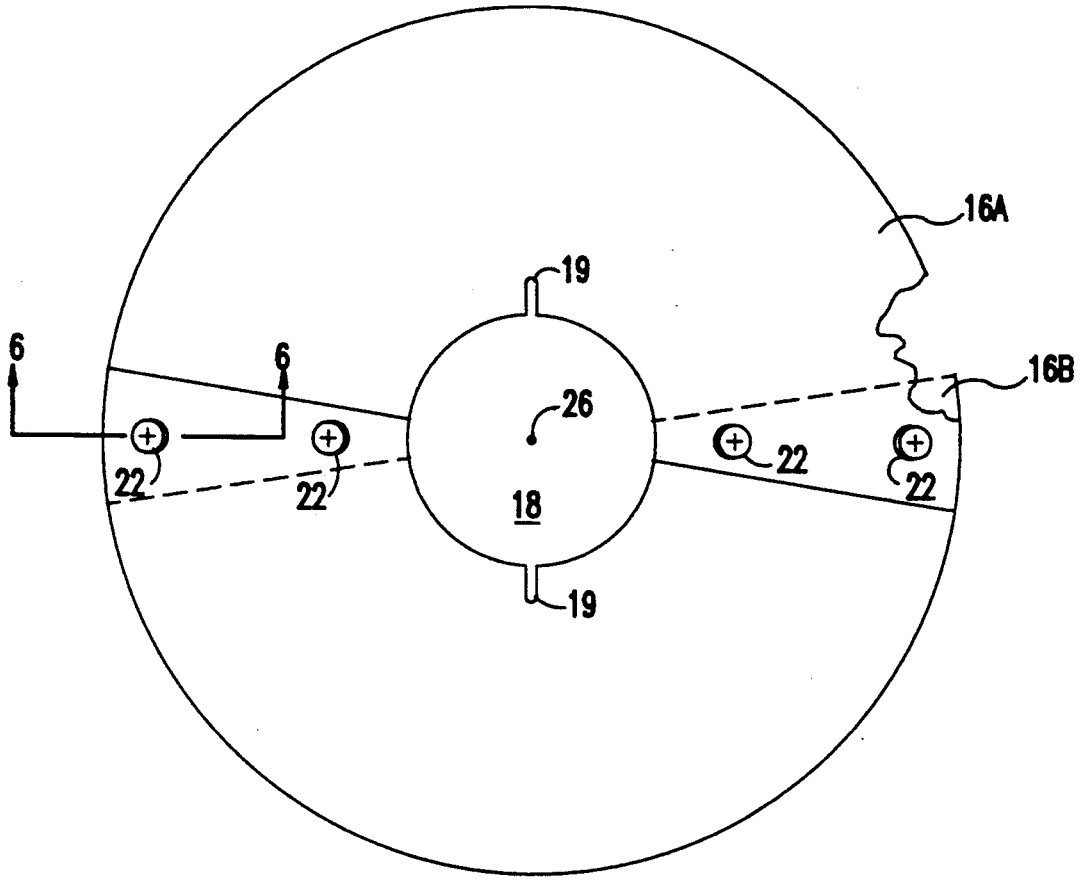
FIG. 2 shows a top plan view of the assembled reflector.
Figure 3:
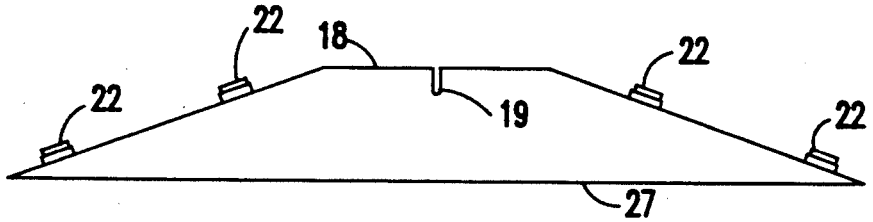
FIG. 3 shows an elevation view of the assembled reflector.

Referring now to FIGS. 1, 2 and 3, an assembled reflector 14 of the present invention is shown in FIG. 1 in place atop a candle lantern that is indicated by the general reference numeral 10. The conical reflector 14 has been slipped down over a lantern bail handle 13 until the inner edge of a circular opening 18 at the top of the reflector rests on an edge of a support ring 15 that surrounds a lantern chimney 17. The bail handle 13 fits through bail handle slots 19 that center the reflector 14, prevent the reflector from slipping and, in addition, hold the bail handle in a generally upright position. Light from a candle flame in the area generally indicated by reference numeral 11 that strikes the interior surface of reflector 14 is directed downward under a lantern base 21, thus eliminating or reducing the shadow that would otherwise be cast by the base.

Figure 4:
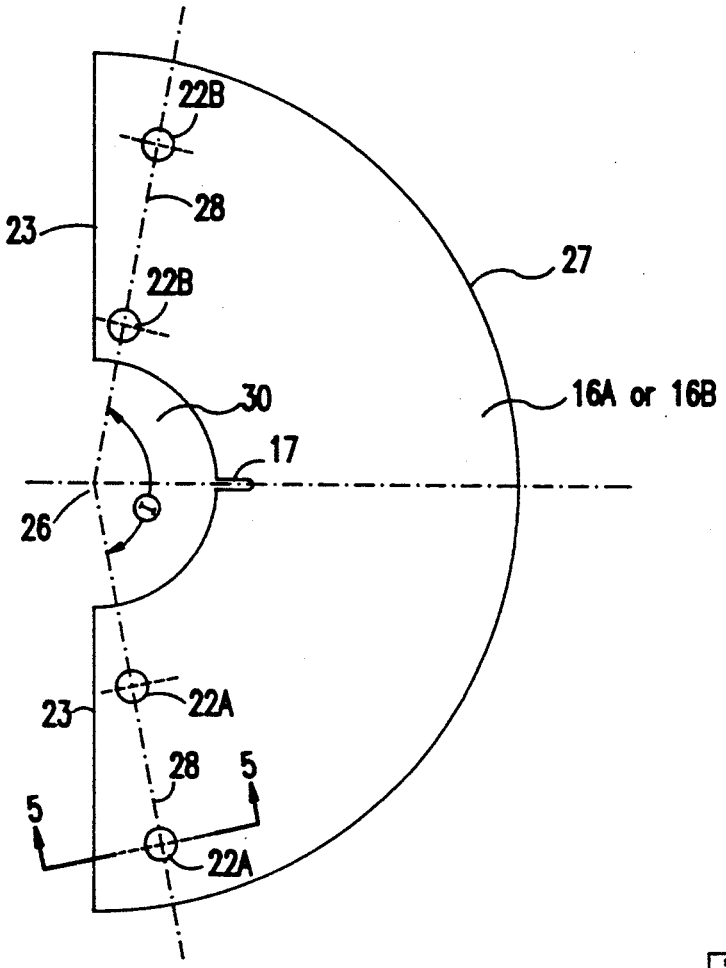
FIG. 4 shows one reflector half in its disassembled, flat configuration.

The assembled conical reflector 14 is comprised of two semicircular pieces 16A and 16B, one of which is shown in FIG. 4. Preferably, although not necessarily, each piece 16A and 16B is identical, one to the other. Each piece is made from a sheet of thin, flexible, resilient material such as a thin steel or aluminum sheet. At least the surface of each semicircular piece that forms the inner surface of the assembled reflector should be generally light reflecting. For example, a bright finished aluminum sheet is satisfactory. Each piece has lead edges 23 on either side of a central cut-out region 30 and a semicircular trailing edge 27 which in this preferred embodiment extends for approximately 180°, although other configurations are possible.

In this preferred embodiment of the invention, each half has four discrete releasable fastener positions 22. On each half a pair of male fasteners 22A are located on one side of opening 30 and a pair of female fasteners 22B are located on the other side of the opening. In this way both halves of the reflector can be identical. Although less desirable, both pairs of male fasteners could be located on one half and both pairs of female connectors on the other half.

With respect to a center point 26 of each half, the fasteners 22 are disposed along lines 28 that form an obtuse angle Θ, so that, in order to mate the fasteners from each half, the halves must be deflected into a conical shape. The size of the angle Θ, is not critical; it will typically be in a range between 160 and 170 degrees. A smaller angle results in a more acute cone angle in the assembled reflector.

The central cut-out region 30 in each half forms an opening 18 in the assembled conical reflector through which the lamp chimney fits. Slot 19 cut in each half accepts the lamp bail handle.

Figure 5:
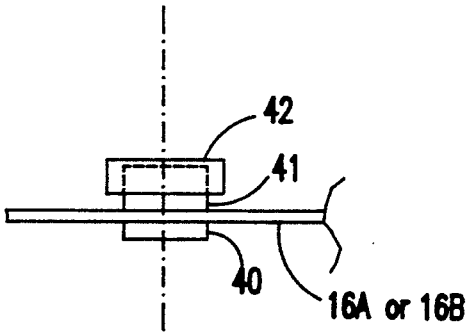
FIG. 5 shows a detail view along the line 5—5 of FIG. 4 of shouldered rivet used in a preferred embodiment of the invention.

Although any suitable fastener may be used, in this preferred embodiment of the invention, shoulder rivets 40 are used as male fasteners, as illustrated in FIG. 5. Each rivet is secured to the sheet 16 and has a post 41 extending from the surface on one side of the sheet. There is an enlarged head 42 atop the post 41.

Figure 6:
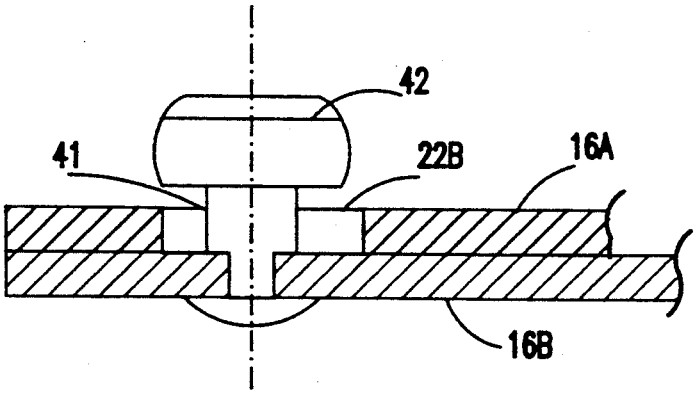
FIG. 6 is a detail sectional view of a mated fastener along line 6—6 of FIG. 2.

The female fasteners are simply a pair of openings formed in the sheet 16. The head 42 of each shoulder rivet fits through the opening, as best seen in FIG. 6. Here it should be noted that the force exerted by each deflected reflector half urges an edge of the opening against a post 41, providing a conical reflector that is easily and repeatably assembled and disassembled, yet secure while assembled.

While the invention has been described in terms of a single preferred embodiment, those skilled in the art will recognize that the invention can be practiced with modification within the spirit and scope of the appended claims.

Having thus descried my invention, what I claim as new and desire to secure by Letters Patent is as follows:

1. A removable, frusto-conical reflector for reflecting light from a lantern, comprising in combination:

two separable, flat, resilient sheets of material, each sheet having at least one light reflective surface;

fasteners that allow the two flat sheets to be easily and repeatably joined and separated, said fasteners comprising four discrete fasteners, two male fasteners on each sheet and two female fasteners on each sheet, each of said female fasteners comprising an opening with a peripheral rim in each sheet, and each of said male fasteners comprised of a rivet secured to said sheet having a post extending from one surface of a sheet to which it is attached and a head carried by said post which is enlarged with respect to said post to form a shoulder that engages said peripheral rim when said sheets are joined;

said fasteners disposed on each of said sheets to hold said two flat sheets in a conical configuration when said fasteners are aligned and joined.

2. A removable, frusto-conical reflector as in claim 1, wherein said head of each rivet passes through one of said opening and a resilient force exerted by said sheets end deformed to form a conical reflector urges an edge of said opening against said post with a portion of said head overlying a portion of said edge.

3. A removable, frusto-conical reflector as in claim 1, wherein each sheet has a slot to accommodate a lantern bail handle.

* * * * *